United States Patent [19]

Hanyu et al.

[11] Patent Number: 4,542,706

[45] Date of Patent: Sep. 24, 1985

[54] LOWER THREAD TENSION ADJUSTING DEVICE OF SEWING MACHINE

[75] Inventors: Susumu Hanyu; Kazumasa Hara; Mikio Koike, all of Tokyo, Japan

[73] Assignee: Janome Sewing Machine Industry Co., Ltd., Japan

[21] Appl. No.: 565,253

[22] Filed: Dec. 23, 1983

[30] Foreign Application Priority Data

Dec. 23, 1982 [JP] Japan ..... 57-194114[U]

[51] Int. Cl.[4] ..... D05B 63/00; D05B 57/26

[52] U.S. Cl. ..... 112/229; 112/231

[58] Field of Search ..... 112/228, 229, 231

[56] References Cited

U.S. PATENT DOCUMENTS

| | | | |
|---|---|---|---|
| 1,188,818 | 6/1916 | Parkes | 112/228 |
| 2,488,052 | 11/1949 | Robert | 112/233 |
| 2,742,008 | 4/1956 | Enos | 112/229 |
| 2,836,136 | 5/1958 | Ayres | 112/229 |
| 4,397,250 | 8/1983 | Zylbert et al. | 112/231 X |

FOREIGN PATENT DOCUMENTS 1068093 10/1959 Fed. Rep. of Germany ..... 112/229

*Primary Examiner*—Wm. Carter Reynolds
*Attorney, Agent, or Firm*—William A. Drucker

[57] ABSTRACT

A lower thread tension adjusting device is disclosed, which is used in combination with a sewing machine having a horizontal rotary loop taker and a stationary bobbin carrier accomodating a bobbin. A lower thread drawn from the bobbin is passed between a base plate secured to the outer face of the bobbin carrier and the free end of a resilient plate having one end secured to the base plate, so that by manipulation of an adjusting screw a variable degree of tension can be applied to the lower thread. The device is so designed that when an index provided on the adjusting screw is in alignment with a reference mark of the base plate, the lower thread will be given a predetermined standard value of tension.

2 Claims, 7 Drawing Figures

LOWER THREAD TENSION ADJUSTING DEVICE OF SEWING MACHINE

BACKGROUND OF THE INVENTION

The invention relates to a lower thread tension adjusting device used in combination with a sewing machine.

In a stitching operation by a sewing machine, it is generally required to adjust the tension of a lower thread in dependence upon a kind and/or thickness of the fabric to be sewn as well as types of stitches. This has been attained in such manner that the lower thread is adjustably pressed against an abutment by a leaf spring which is subjected to manipulation of an adjusting screw by a machine operator. This tension adjustment, however, has been carried out by guesswork with no reference and therefore can not easily be done by an unskilled operator.

SUMMARY OF THE INVENTION

It is therefore an object of the invention to eliminate the defects and disadvantages which have been encountered in the prior art manner of adjustment of lower thread tension.

Another object of the invention is to provide an improved device for adjusting lower thread tension, capable of facilitating a rapid and accurate adjustment in accordance with requirements in types of stitches, with reference to a predetermined standard value of lower thread tension.

According to the invention there is provided an improved lower thread tension adjusting device used in combination with a sewing machine which comprises a horizontal rotary loop taker, a bobbin carrier positioned in the horizontal rotary loop taker and kept stationary with respect to the loop taker, a bobbin loaded with a lower thread and contained in the bobbin carrier, an arcuate base plate secured to the outer face of the bobbin carrier, a resilient plate having one end secured to the base plate and the other free end resiliently contacting the base plate, and an adjusting screw extending through the resilient plate and threaded into the central portion of the base plate, said adjusting screw being manipulated to adjust the tension applied to the lower thread inserted between the resilient plate and the base plate, wherein the base plate is provided with a reference mark at the central portion thereof, and the adjusting screw has an index provided thereon, said adjusting screw being rotated to bring the index into alignment with the reference mark, to thereby give predetermined standard tension to the lower thread.

BRIEF DESCRIPTION OF DRAWINGS

Further objects and advantages of the invention can by fully understood from the following detailed description when read in conjunction with the accompanying drawings in which.

PREFERRED EMBODIMENTS OF THE INVENTION

Figure 1:
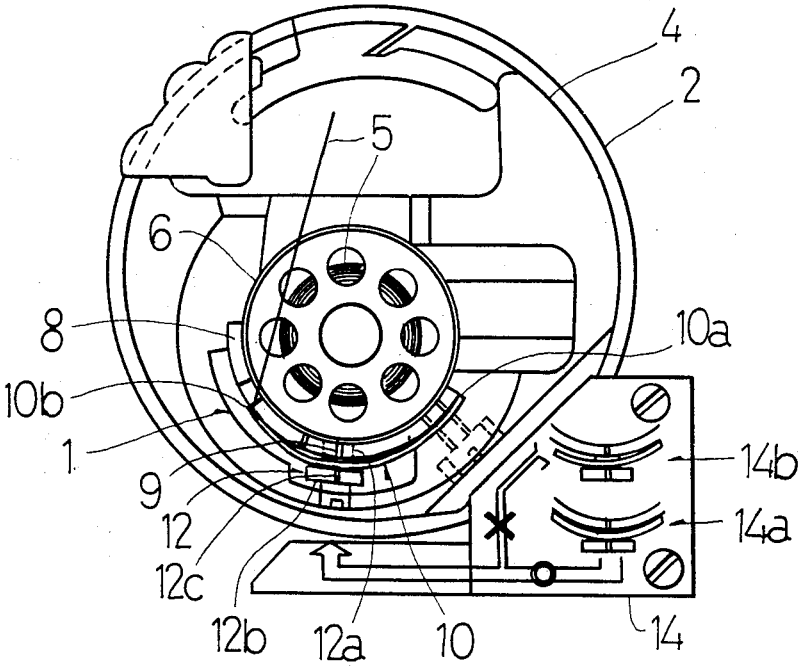
FIG. 1 is a plan view of a lower thread tension adjusting device embodying the invention and located in a horizontal loop taker.
Figure 2:
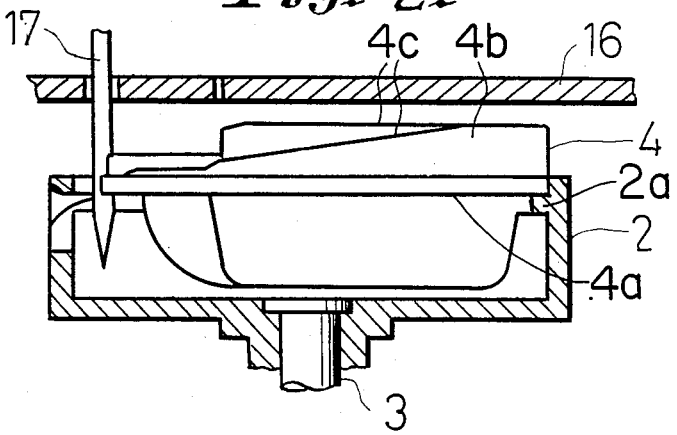
FIG. 2 is a longitudinal sectional view of the horizontal loop taker shown in FIG. 1.

Referring specifically to FIGS. 1 and 2, a lower thread tension adjusting device 1 according to the invention is provided in combination with a horizontal loop taker 2 having a vertically extending central rotary shaft 3. A bobbin carrier 4 is detachably mounted within the loop taker 2 but prevented from rotation by means of a stop plate 14 while the loop taker 2 is rotating. A bobbin 6 loaded with a lower thread 5 is contained in the bobbin carrier 4. An arcuate base plate 8 is secured to the outer face of the bobbin carrier 4 and has a reference mark 9 provided at the upper edge thereof. A resilient plate 10 has one end 10*a* secured to the arcuate base plate 8 and the other free end 10*b* resiliently contacting the outer face of the arcuate plate 8.

Figure 3:
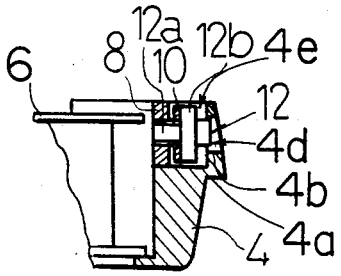
FIG. 3 is a fragmentary longitudinal sectional view of a bobbin carrier showing a part of the device shown in FIG. 1.
Figure 4:
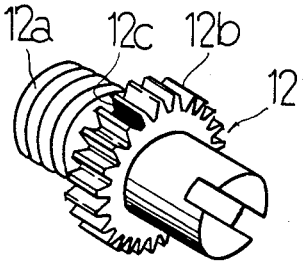
FIGS. 4 through 7 are perspective views showing adjustment screw provided with modified embodiments of the indices respectively.

Further in reference to FIG. 3, an adjusting screw 12 has a threaded shank 12*a* extended through the central portion of the resilient plate 10 and screwed into the base plate 8. The screw 12 has a flange 12*b* normally in contact with the central portion of the resilient plate 10. By rotational manipulation of the screw 12, the resilient plate 10 may be positionally adjusted toward or away from the base plate 8 to give a variable pressure to the lower thread 5 extending between the base plate 8 and the free end 10*b* of the resilient plate 10, to thereby adjust the lower thread tension.

An index 12*c* is provided on the edge of the flange 12*b* of the screw 12, which will be brought into alignment with the reference mark 9 of the base plate 8 when the lower thread tension is adjusted to a predetermined standard value.

In FIG. 2, the numerals 16 denotes a cover plate and 17 a vertical reciprocating needle, respectively, which are provided as usual and conventional. Therefore, no further description thereof would be necesssary.

According to the embodiment described above, the lower thread tension can be readily adjusted to the predetermined standard value by firstly rotating the screw 12 in the clockwise direction in FIG. 1 until the screw comes to stop and then by rotating back the screw to align the index 12*c* with the reference mark 9 within one complete rotation of the screw. Moreover, in a special case wherein the lower thread tension should be adjusted to a value other than the standard value, the adjustment can also be easily done with the help of the index 12*c* and the reference mark 9, that is by rotating the screw 12 in the clockwise or counterclockwise direction to displace the index 12*c* with respect to the reference mark 9, to thereby increase or reduce the tension applied to the lower thread 5.

In the embodiment shown in FIG. 1, the stop plate 14 may be used as a display showing illustrations 14*a* and 14*b* for thread tension adjustment. More particularly, mere appearance that the index 12*c* is in alignment with the reference mark 9 will not always mean that the predetermined standard value of lower thread tension has been attained, but may include a difference in one or more revolution of the screw 12. The illustration 14*a* shows a proper condition of the resilient plate 10, whereas the illustration 14*b* shows an improper condition of the resilient plate wherein the free end 10*b* is not in contact with the base plate 8. Even if the index 12*c* is in alignment with the reference mark 9, no tension is given to the lower thread 5 when the resilient plate is positioned as shown in the illustration 14*b*. In this case, the operator should rotate the screw 12 in the clockwise direction until the free end 10*b* of the resilient plate 10 comes to contact the base plate 8 as shown in the illustration 14*a* in the manner as mentioned above.

Figure 5:
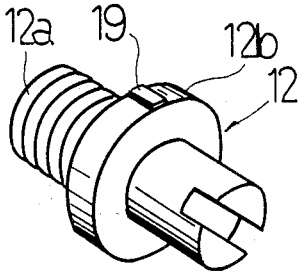
Figure 6:
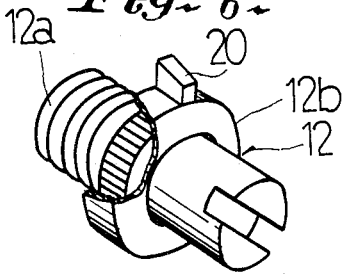
Figure 7:
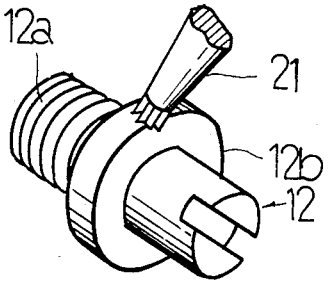

The index 12*c* of screw 12 can be variously modified as shown in FIGS. 4–7, by way of example. In the embodiment shown in FIG. 4, the flange 12*b* is formed as a gear having one tooth colored black to be an index 12*c*. Alternatively, the index may be a sheet plate 19 attached to the flange 12*b*, or a projection 20 formed on the flange 12*b*, or may be impressed on the flange 12*b* by an end mill 21, as shown in FIGS. 5, 6 and 7, respectively.

In reference to FIGS. 2 and 3, the loop taker 2 has a race 2*a* formed all around on the inside thereof, and the bobbin carrier 4 is supported on the race 2*a* by way of a flange 4*a* formed all around the bobbin carrier on the outside thereof. The bobbin carrier 4 has a vertical wall 4*b* formed on the upper side of the flange 4*a*, the vertical wall 4*b* providing an upper edge or face 4*c* around the bobbin 6 contained in the bobbin carrier 4. The upper edge 4*c* will guide therealong a limb of an upper or needle thread loop (not shown) while the loop is caught by a beak of the loop taker 2 and is enlarged around the bobbin carrier 4 and is then drawn up by a take-up lever (not shown) of the sewing machine.

As particularly shown in FIGS. 1 and 3, a space or chamber 4*e* is formed between the arcuate base plate 8 and a part of the vertical wall 4*b*. Within the space 4*e* is positioned a flange portion 12*b* of the tension adjusting screw 12, while the threaded shank portion 12*a* extends through the resilient plate 10 and is screwed into the arcuate base plate 8. The vertical wall 4*b* has an opening 4*d* formed thereat in alignment with the tension adjusting screw 12, so that the screw may be manipulated through the opening 4*d* by means of a screw driver or the like instruments. The opening 4*d* is designed to be smaller in diameter than the flange 12*b* of the screw 12, which will prevent the screw 12 from dropping out of the bobbin carrier 4 even if the machine operator happens to excessively loosen the screw 12.

As many different embodiments of the invention may be made without departing from the spirit and scope thereof, it is to be understood that the invention is not limited to the specific embodiments thereof except as defined in the appended claims.

What is claimed is:

1. A lower thread adjusting device used in combination with a sewing machine comprising a horizontal rotary loop taker, a bobbin carrier positioned in the horizontal loop taker and kept stationary with respect to the loop taker, a bobbin loaded with a lower thread and contained in the bobbin carrier, an arcuate base plate secured to the bobbin carrier, a resilient plate having one end secured to the base plate and the other free and resiliently contacting the base plate, and an adjusting screw being manipulated to adjust tension applied to a lower thread inserted between the resilient plate and the base plate, the improvement wherein:

(a) said base plate has a reference mark and said adjusting screw has an index mark at a flange portion thereof, so that said adjusting screw is rotated to bring said index mark into alignment with said reference mark to thereby give a predetermined standard tension to said lower thread; and (b) said bobbin carrier is provided at an upper portion thereof with a circumferential vertical wall, which defines a space between a part thereof and said base plate for accommodating said flange portion of said adjusting screw and which includes an opening formed in alignment with said adjusting screw so as to make said adjusting screw operable therethrough, said opening being smaller than said flange portion of said adjusting screw.

2. The device as defined in claim 1 wherein said index mark is provided on said flange portion of said adjusting screw.

* * * * *